US005649875A

United States Patent [19]

Spector

[11] Patent Number: 5,649,875

[45] Date of Patent: Jul. 22, 1997

[54] HUMANOID TOY MISSILE

[76] Inventor: Donald Spector, 380 Mountain Rd., Union City, N.J. 07087

[21] Appl. No.: 673,506

[22] Filed: Jul. 1, 1996

Related U.S. Application Data

[63] Continuation-in-part of Ser. No. 596,652, Feb. 5, 1996, Pat. No. 5,577,732.

[51] Int. Cl.[6] ..... A63B 65/00; A63H 3/06

[52] U.S. Cl. ..... 473/596; 446/226; 473/610; 473/614

[58] Field of Search ..... 273/317, 58 H; 446/225, 223, 226; 473/575, 576, 596, 597, 610, 614, 569

[56] References Cited

U.S. PATENT DOCUMENTS 2,685,758 8/1954 Ochs ..... 446/223
3,664,058 5/1972 Brieske ..... 446/226 X
4,917,381 4/1990 Spector ..... 273/58 H
5,577,732 11/1996 Spector ..... 273/317

*Primary Examiner*—William H. Grieb
*Attorney, Agent, or Firm*—Michael Ebert

[57] ABSTRACT

A toy missile resembling a humanoid figure, the missile including a plastic film casing confining an inflated balloon, which causes the casing to assume a ball-like form. Printed on the front face of the casing is the head and torso of the figure. Hinged to the upper zone of the casing and extending therefrom is a first pair of plastic film pockets in each of which is entrapped a compressible filler to define the arm and hand appendages of the figure. Hinged to the lower zone of the casing and extending therefrom is a second pair of plastic film pockets in each of which is entrapped a compressible filler to define the leg and feet appendages of the figure. When a player grasps one of the appendages and then whirls the missile and lets it fly, the ball then rotates in the course of flight, causing the appendages to stretch out from the ball to stabilize the flight pattern.

7 Claims, 2 Drawing Sheets

HUMANOID TOY MISSILE

RELATED APPLICATION

This application is a continuation-in-part of my application Ser. No. 08/596,652, filed Feb. 5, 1996, now U.S. Pat. No. 5,577,732, entitled "TOY MISSILE."

BACKGROUND OF INVENTION

1. Field of Invention

This invention relates generally to toy missiles which are launched by whirling the missile and then releasing it to let the missile fly, and more particularly to a humanoid toy missile formed by an inflated casing having two pairs of soft appendages hinged thereon to define a humanoid figure.

2. Status of Prior Art

My prior U.S. Pat. No. 4,834,352, (Spector) discloses a pneumatic play ball having an outer casing formed of non-stretchable material which when fully expanded, assumes a ball configuration. Within the casing is an inflatable balloon whose neck initially projects through a small port in the casing. When the balloon is inflated, it expands to engage and conform to the inner surface of the casing, after which the neck is tied and pushed within the port whereby the balloon in then fully encased. Though prior '352 patent has distinct advantages over conventional beach balls, it is still lacking in weight and therefore subject to wind deflection.

To overcome this drawback, my prior U.S. Pat. No. 4,917,381 (Spector) discloses a variable weight play ball in which weight is imparted thereto by a layer of water which is uniformly and symmetrically distributed throughout the ball whereby the play characteristics of the ball are comparable to those of conventional heavy balls of high quality.

My prior U.S. Pat. No. 5,288,261 (Spector) discloses a figurative toy missile in animal-like or humanoid form defined by a head and a torso having appendages extending therefrom. The missile structure is such that when the missile is thrown by a player, it will spin, or execute other excursions in flight, depending on how the appendages are grasped by the player. The torso is formed by an outer fabric casing enclosing a rubber balloon inflated with water, whereby the torso functions as a weighted ball.

My copending application, above-identified, discloses a toy missile having a hollow head created by a collapsible plastic film casing and a balloon inflated therein, causing the head to assume a globular form. Projecting from the casing are shaped pieces which impart a figurative or fanciful form to the head. Extending from the rear pole of the globular head and held thereto by a tail is a streamer. When a player grasps the streamer and then whirls the missile and lets it fly, the streamer acts as a tail fin to stabilize the flight pattern. Deposited in the balloon is a liquid charge which due to centrifugal forces generated by the whirling action, causes the liquid to form a concentrated mass at the leading pole of the head. This liquid mass acts to lengthen the flight path of the missile.

SUMMARY OF INVENTION

In view of the foregoing, the main object of the invention is to provide a toy missile in the form of a humanoid figure having arm and leg appendages whereby when one of these appendages is grasped by a player and the missile is whirled and then released to let it fly, the missile then rotates in the course of its flight and its flight pattern is stabilized by the appendages.

More particularly, an object of the invention is to provide a missile of the above type in which the head and torso of the humanoid figure are created by a a casing having a balloon inflated therein to form a ball, the appendages of the figure being hinged to the casing.

A significant feature of the invention is that the casing and the appendages which form the humanoid figure are created by superposed sheets of synthetic plastic film material which are die cut and periphery sealed.

Briefly stated, these objects are attained by a toy missile resembling a humanoid figure, the missile including a plastic film casing confining an inflated balloon, which causes the casing to assume a ball-like form. Printed on the front face of the casing is the head and torso of the figure. Hinged to the upper zone of the casing and extending therefrom is a first pair of plastic film pockets in each of which is entrapped a compressible filler to define the arm and hand appendages of the figure. Hinged to the lower zone of the casing and extending therefrom is a second pair of plastic film pockets in each of which is entrapped a compressible filler to define the leg and feet appendages of the figure. When a player grasps one of the appendages and then whirls the missile and lets it fly, the ball then rotates in the course of flight, causing the appendages to stretch out from the ball to stabilize the flight pattern.

BRIEF DESCRIPTION OF DRAWINGS

For a better understanding of the invention, as well as further features thereof, reference is made to the detailed description thereof to be read in connection with the annexed drawings wherein.

DESCRIPTION OF INVENTION

Structure of Missile

Figure 1:
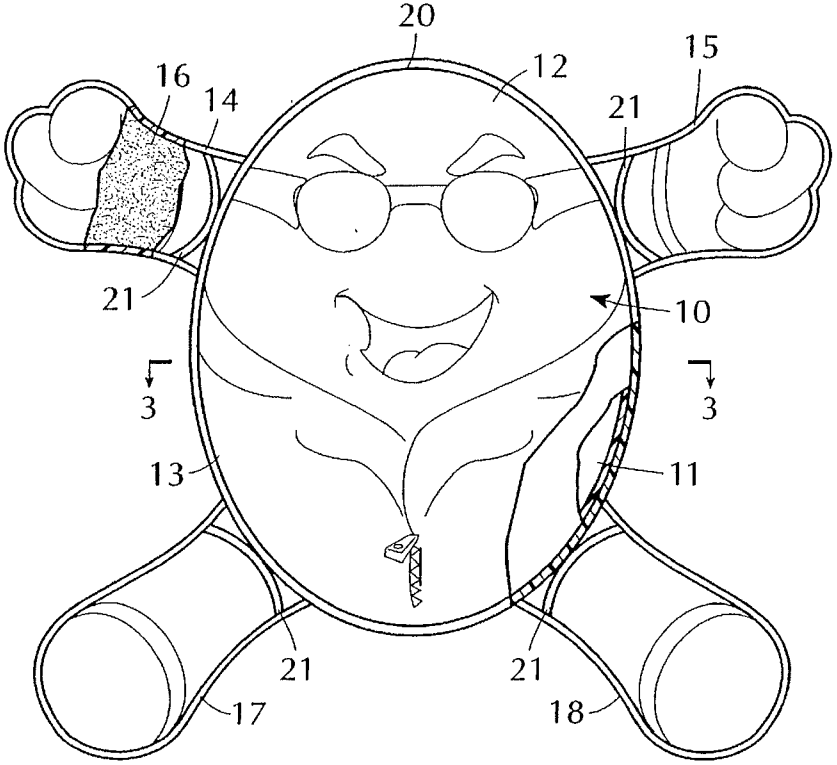
FIG. 1 is a perspective front view of a humanoid toy missile in accordance with the invention.

Referring now to FIG. 1, there is shown in front view a toy missile resembling a humanoid figure in accordance with the invention. The missile includes a casing section, generally identified by reference numeral 10, which in its collapsed state has a two-dimensional oval shape. Casing 10 is formed of non-stretchable flexible plastic film material, such as PVC or polyethylene. Confined within casing 10 is a bladder or rubber balloon 11 which when inflated, conforms to the casing and causes it to assume the three-dimensional form of an oval ball.

Printed, screened or otherwise impressed on the front face of casing 10 is a multi-colored drawing of a selected humanoid figure except for the appendages. Thus what mainly appears on the front face is the head 12 and the torso 13 of the humanoid figure, head 12 being in the upper zone of the casing and torso 13 in the lower zone thereof.

Hinged to the upper zone of casing 10, and extending from opposite sides thereof at the shoulder position of the figure is a first pair of appendages 14 and 15, these being formed by plastic film pockets integral with the plastic film casing 10. The pockets are shaped and printed to define the arms and hands of the figure. Entrapped within each of these pockets is stuffing or compressible padding, such as a flexible foam plastic pad 16. This filler serves to give a soft, three-dimensional body to these appendages.

Hinged to the lower zone of the casing and extending outwardly from the crotch position of the torso 13 is a second pair of appendages 17 and 18, these being formed by plastic film pockets integral with the plastic film casing 10. The pockets are shaped and printed to define the legs and feet of the figure. Entrapped within each of these pockets is a compressible filler, such as pad 16 to impart body to these appendages. Thus the appendages extending from the oval ball together with the ball create a humanoid figure.

By a humanoid figure is meant any figure which like a human being has arm and leg appendages, but not necessarily a human face. Thus the humanoid figure may be a fanciful creature from outer-space or an animal-like figure having two pairs of appendages.

Figure 2:
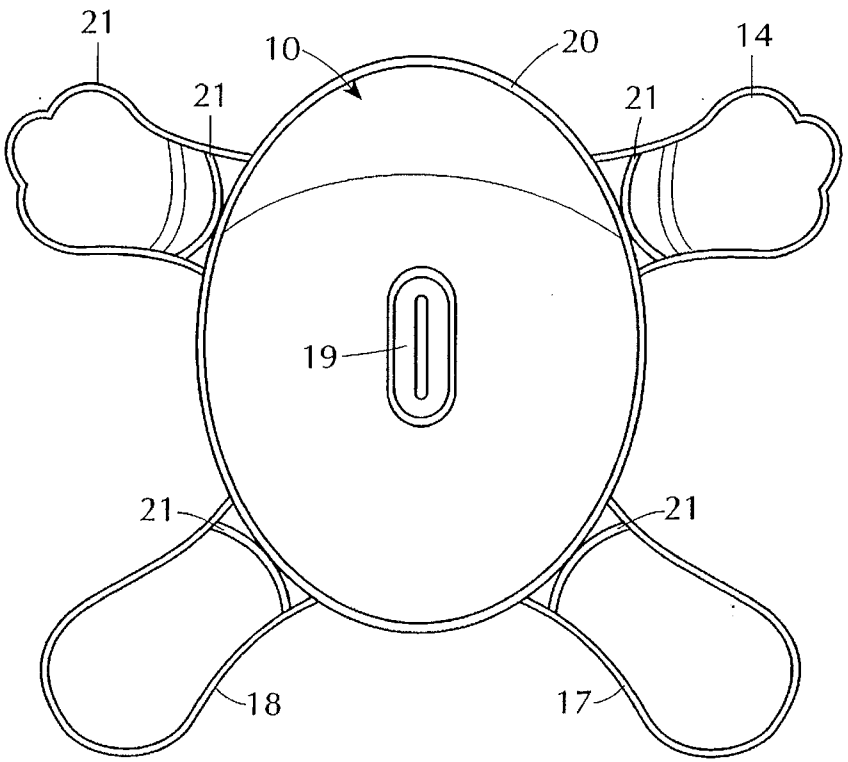
FIG. 2 is a perspective rear view of the missile.

The rear face of casing 10, as shown in FIG. 2, has a slot 19 at its center to admit balloon 11 into the casing when the balloon is in a deflated state. The neck of the balloon then projects from the slot so that the ballon may be mouth inflated to conform to the expanded casing. The neck is then tied to seal the balloon and it is pushed into the casing so that it lies under the slot.

Production of Missile

In producing a missile resembling a human figure, as shown in FIG. 1, the preferred technique for this purpose is to make use of the superposed sheets of thermoplastic film material, such as PVC or polyethylene, the top sheet having oriented in its exposed face graphics shown in FIG. 1 and the rear sheet having printed on its exposed face thereon the graphics shown in FIG. 2.

Figure 5:
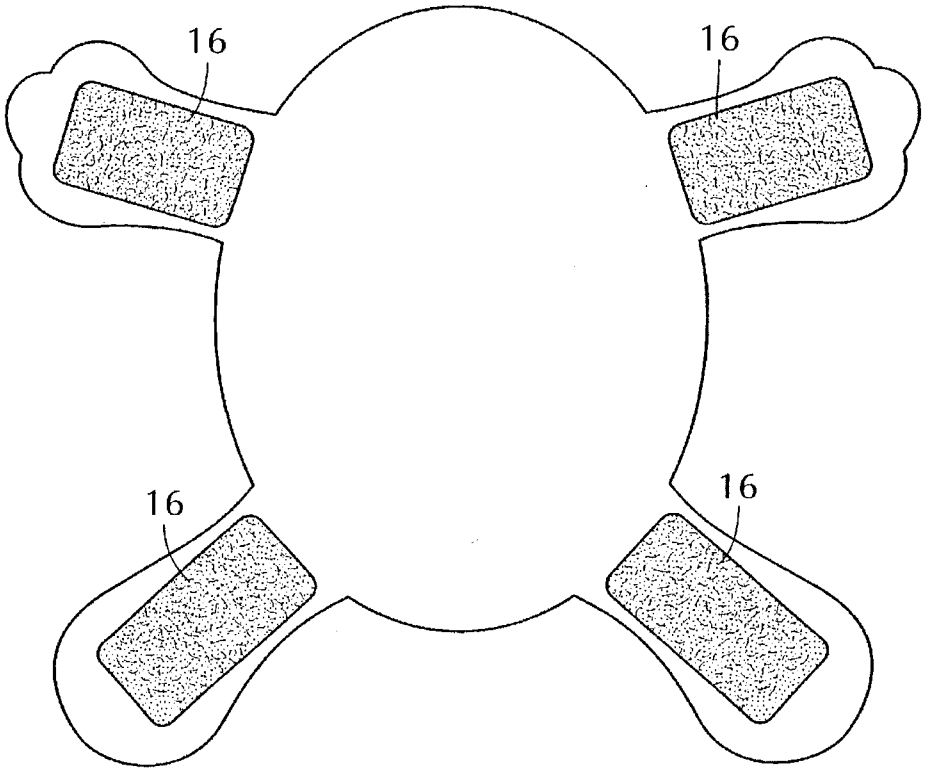
FIG. 5 illustrates one step in the method of producing the missile.
Figure 3:
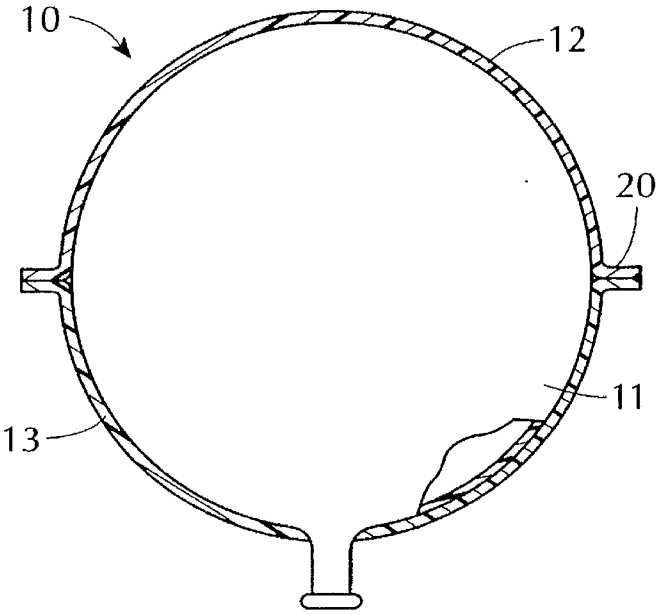
FIG. 3 is a section taken through the casing section of the missile.
Figure 4:
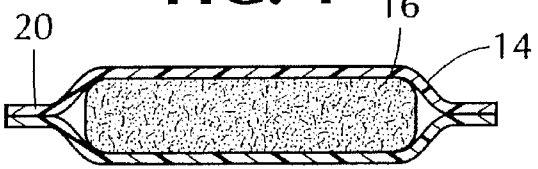
FIG. 4 is a section taken through a stuffed appendages of the missile.

The superposed sheets are then die cut to define the oval casing 10 and the two pairs of appendages 14–15 and 17–18. Placed between the appendages on the die cut rear sheet and the corresponding appendages on the die cut top sheet are the compressible pads 16, as shown in FIG. 5.

Then the die cut superposed thermoplastic sheets with the pads sandwiched therebetween are peripherally sealed, ultrasonically, or by heat and pressure to complete the pockets which define the appendages, and to complete the oval casing 10 to which the appendages are hinged. The oval sealing line 20 on the periphery of casing 10 serves not only to seal the casing, but also to seal the end of each appendage pocket integral with the casing. However, in order to entrap the pad 16 within each pocket so that it does not shift therein, an arcuate seal line 21 is provided adjacent the seal line 20 of the casing which forms the hinge of the appendages.

Operation of Missile

In order to launch a missile, a player grasps it by one of the appendages and then whirls the missile and releases it to let it fly. Because the missile has been whirled, the oval ball section of the missile is caused to rotate in the course of flight. The resultant centrifugal forces cause the soft appendages extending from the ball to stretch out and thereby stabilize the flight pattern.

To modify the flight characteristics of the missile, before inflating the balloon one may feed a charge of water into the balloon to give some degree of heft to the missile. Or one may inflate the balloon with water or other liquid and thereby provide a much heavier ball.

The missile is innocuous, for should it strike a child or an object, it will not injure the child or damage the object, for the soft appendages of the missile cushion the impact.

While there has been shown a preferred embodiment of a humanoid toy missil in accordance with the invention, it is to be understood that many changes may be made therein without departing from the spirit of the invention.

I claim:

1. A toy missile resembling a humanoid figure comprising:

A. a casing formed of synthetic plastic film enclosing an inflated balloon causing the casing to assume a ball-like form having a center, the casing having a front face on which is printed the head and torso of the figure;

B. a first pair of plastic film pockets integral with the casing and formed of the same material hinged to an upper zone of the casing above said center, each pocket having a compressible pad entrapped therein to define the arm and hand appendages of the figure; and C. a second pair of plastic film pockets integral with the casing and formed of the same material hinged to a lower zone of the casing below said center and extending therefrom, each pocket having a compressible pad entrapped therein to define the leg and feet appendages of the figure, whereby when a player grasps one of the appendages and then whirls the missile and lets it fly, the ball then rotates in the course of flight, causing the appendages to stretch out from the ball to stabilize the flight pattern.

2. A toy missile as set forth in claim 1, in which said casing has a slot on the rear face thereof at said center to admit the balloon in a deflated state.

3. A toy missile as set forth in claim 1, in which the casing has a two-dimensional oval shape and the ball produced by the balloon confined in the casing has a three dimensional oval shape.

4. A toy missile as set forth in claim 1, in which each pad is formed of flexible foam plastic material.

5. A method of producing a toy missile as set forth in claim 1, comprising the steps of:

A. die cutting two superposed sheets of synthetic plastic film materials to define the casing and the first and second pair of plastic film pockets extending from the casing;

B. inserting between the sheets forming each of the pockets said pad of compressible material; and C. then bonding the two superposed die cut sheets along the periphery of the casing and along the periphery of the pockets to enclose the casing and the pockets.

6. A method, as set forth in claim 5, in which the sheets are formed of thermoplastic film material and said bonding is effected by heat sealing.

7. A method as set forth in claim 6, in which the film material is PVC.

* * * * *